US011047354B2

(12) United States Patent
Schmieder et al.

(10) Patent No.: US 11,047,354 B2
(45) Date of Patent: Jun. 29, 2021

(54) DECOUPLING ELEMENT FOR A FUEL INJECTION DEVICE

(71) Applicant: Robert Bosch GmbH, Stuttgart (DE)

(72) Inventors: Dietmar Schmieder, Markgroeningen (DE); Corren Heimgaertner, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 66 days.

(21) Appl. No.: 16/142,811

(22) Filed: Sep. 26, 2018

(65) Prior Publication Data

US 2019/0107091 A1 Apr. 11, 2019

(30) Foreign Application Priority Data

Oct. 10, 2017 (DE) ..... 10 2017 218 008

(51) Int. Cl.
*F02M 61/14* (2006.01)

(52) U.S. Cl.
CPC ..... *F02M 61/14* (2013.01); *F02M 2200/09* (2013.01); *F02M 2200/306* (2013.01); *F02M 2200/85* (2013.01)

(58) Field of Classification Search
CPC ..... F02M 61/14; F02M 2200/858; F02M 2200/09; F02M 2200/306; F02M 2200/85
See application file for complete search history.

(56) References Cited

U.S. PATENT DOCUMENTS 5,785,024 A * 7/1998 Takei ..... F02F 11/00 123/470
5,954,343 A * 9/1999 Sumida ..... F02M 61/14 277/434
6,009,856 A 1/2000 Smith, III et al.
6,578,554 B2 * 6/2003 Schroeer ..... F02M 61/14 123/470
6,805,103 B1 * 10/2004 Sumida ..... F02M 61/14 123/470

(Continued)

FOREIGN PATENT DOCUMENTS

DE 10027662 A1 12/2001
DE 10038763 A1 2/2002

(Continued)

*Primary Examiner* — Gonzalo Laguarda
(74) *Attorney, Agent, or Firm* — Norton Rose Fulbright US LLP; Gerard Messina

(57) ABSTRACT

The decoupling element is for a fuel injection device, in which a low-noise configuration is implemented, and includes at least one fuel injector and a receiving borehole in a cylinder head for the fuel injector, and the decoupling element is introduced between a valve housing of the fuel injector and a wall of the receiving borehole. The decoupling element has a bowl- or cup-shaped configuration, and includes a radially outer contact area and a radially inner contact area with which the decoupling element is radially inwardly and radially outwardly placeable against the fuel injector and a shoulder of the receiving borehole. The radially inner contact area of the decoupling element has a spherically convex contact surface whose curvature has a largely constant spherical radius. The fuel injection device is particularly suited for the direct injection of fuel into a combustion chamber of a mixture-compressing spark ignition internal combustion engine.

9 Claims, 4 Drawing Sheets

(56) References Cited

U.S. PATENT DOCUMENTS

| | | | | |
|---|---|---|---|---|
| 6,807,945 | B2 * | 10/2004 | Reiter | F02M 61/14 123/470 |
| 6,899,087 | B2 * | 5/2005 | Norgauer | F02M 61/14 123/467 |
| 7,004,478 | B2 * | 2/2006 | Spence | F16J 15/0887 277/626 |
| 7,373,925 | B2 * | 5/2008 | Reiter | F02M 61/14 123/467 |
| 7,832,376 | B2 * | 11/2010 | Mueller | F02M 61/14 123/470 |
| 8,069,842 | B2 * | 12/2011 | Kannan | F02M 61/14 123/470 |
| 9,677,606 | B2 * | 6/2017 | Pischel | F16C 23/048 |
| 9,897,038 | B2 * | 2/2018 | Claus | F16J 15/0887 |
| 2019/0107092 | A1 * | 4/2019 | Schmieder | F02M 61/168 |

FOREIGN PATENT DOCUMENTS

| | | | |
|---|---|---|---|
| DE | 10108466 | A1 | 9/2002 |
| DE | 10 2005 057 313 | A1 | 6/2007 |
| EP | 1223337 | A1 | 7/2002 |

* cited by examiner

DECOUPLING ELEMENT FOR A FUEL INJECTION DEVICE

RELATED APPLICATION INFORMATION

The present application claims priority to and the benefit of German patent application no. 10 2017 218 008.0, which was filed in Germany on Oct. 10, 2017, the disclosure which is incorporated herein by reference.

FIELD OF THE INVENTION

The present invention is directed to a decoupling element for a fuel injection device.

BACKGROUND INFORMATION

FIG. 1 shows an example of a fuel injection device known from the related art, in which a flat intermediate element is provided on a fuel injector that is installed in a receiving borehole of a cylinder head of an internal combustion engine. Such intermediate elements, as support elements in the form of a washer, are placed on a shoulder of the receiving borehole of the cylinder head in a known manner. With the aid of such intermediate elements, manufacturing and installation tolerances are compensated for, and a bearing is ensured that is free of lateral forces, even when the fuel injector is slightly tilted. The fuel injection device is particularly suited for use in fuel injection systems of mixture-compressing spark ignition internal combustion engines.

Another type of a simple intermediate element for a fuel injection device is already known from DE 101 08 466 A1. The intermediate element is a washer, having a circular cross section, that is situated in an area in which the fuel injector as well as the wall of the receiving borehole extend in the cylinder head in the shape of a truncated cone, and that is used as a compensation element for bearing and supporting the fuel injector.

Intermediate elements for fuel injection devices that are more complicated and much more difficult to manufacture are discussed in DE 100 27 662 A1, DE 100 38 763 A1, and EP 1 223 337 A1, among others. These intermediate elements are characterized in that they all have a multi-part or multi-layer configuration, and are sometimes intended to take on sealing and damping functions. The intermediate element discussed in DE 100 27 662 A1 includes a base body and a support body in which a sealant, through which a nozzle body of the fuel injector extends, is inserted. A multi-layer compensation element is known from DE 100 38 763 A1 that is made up of two rigid rings and an elastic spacer ring situated in between in a sandwich-like manner. This compensation element allows tilting of the fuel injector with respect to the axis of the receiving borehole over a relatively large angular range, as well as radial displacement of the fuel injector from the center axis of the receiving borehole.

A likewise multi-layer intermediate element is also discussed in EP 1 223 337 A1, this intermediate element being made up of multiple washers made of a damping material. The damping material made of metal, rubber, or PTFE is selected and configured in such a way that noise damping of the vibrations and noise generated by operation of the fuel injector is made possible. However, for this purpose the intermediate element must include four to six layers in order to achieve a desired damping effect.

Damping elements in a disk shape for a fuel injector, in particular an injector for injecting diesel fuel in a common rail system, are also already discussed in DE 10 2005 057 313 A1. The damping disks are intended to be inserted between the injector and the wall of the receiving borehole in the cylinder head in such a way that damping of structure-borne noise is made possible, even under high pressing forces, so that the noise emissions are reduced. The ring-shaped damping element rests with an annular face against the support surface of the cylinder head, and with a circumferential ridge rests against the conical support surface of the injector. However, this overall system has the disadvantage that the contact points of the damping element on the cylinder head and on the injector, viewed in the radial direction, are quite close to one another, and the damping element has a fairly stiff configuration due to its installation situation. As a result, clearly audible noise emissions are still present in this system.

In addition, U.S. Pat. No. 6,009,856 A provides for enclosing the fuel injector with a sleeve and filling the resulting space with an elastic, noise-damping compound to reduce noise emissions. However, this type of noise damping is very complicated, difficult to install, and costly.

SUMMARY OF THE INVENTION

The decoupling element according to the present invention for a fuel injection device having the characterizing features described herein has the advantage that an improved reduction in noise is achieved, in a very simple configuration, by decoupling or insulating. According to the present invention, the decoupling element has a bowl- or cup-shaped configuration, with a radially outer contact area and a radially inner contact area with which the decoupling element is radially inwardly and radially outwardly placeable against the fuel injector and a shoulder of the receiving borehole, the radially inner contact area of the decoupling element having a spherically convex contact surface whose curvature is configured with a largely constant spherical radius.

It is particularly advantageous to likewise provide a cardanic bearing between the fuel injector and the decoupling element, in the area of the radially outer contact area. In this way, during operation a constant lever arm that is independent of tolerances may be ensured between the two radial positions of the contact surfaces of the decoupling element over the entire service life. Further advantages of the arrangement according to the present invention are the defined axial rigidity with very low dispersion, and the axial support force that is free of lateral force. In addition, there is advantageously no sharp-edged contact at the contact areas of the decoupling element.

Due to the shaping of the decoupling element according to the present invention, the tensile stresses and compressive stresses in the decoupling element in the installed state are minimized in a particularly advantageous manner.

Advantageous refinements and improvements of the fuel injection device described herein are possible as a result of the measures set forth in the further descriptions herein.

Ideally, the radially inner spherical segment-shaped contact surface of the decoupling element is provided with a curvature whose spherical radius has a midpoint situated approximately on the valve longitudinal axis of the fuel injector, which as a whole optimizes the reduction in the stresses, the noise decoupling, and the centered bearing of the decoupling element.

The decoupling element advantageously has an annular disk shape and an overall bowl- or cup-shaped configuration, and is manufactured as a stamped/bent part or as a turned part.

Depending on the use in an alternating pressure system or in a constant pressure system, the decoupling element is particularly advantageously configured with a nonlinear progressive spring characteristic or with a nonlinear degressive spring characteristic.

Exemplary embodiments of the present invention are illustrated in simplified form in the drawings, and explained in greater detail in the following description.

DETAILED DESCRIPTION

Figure 1:
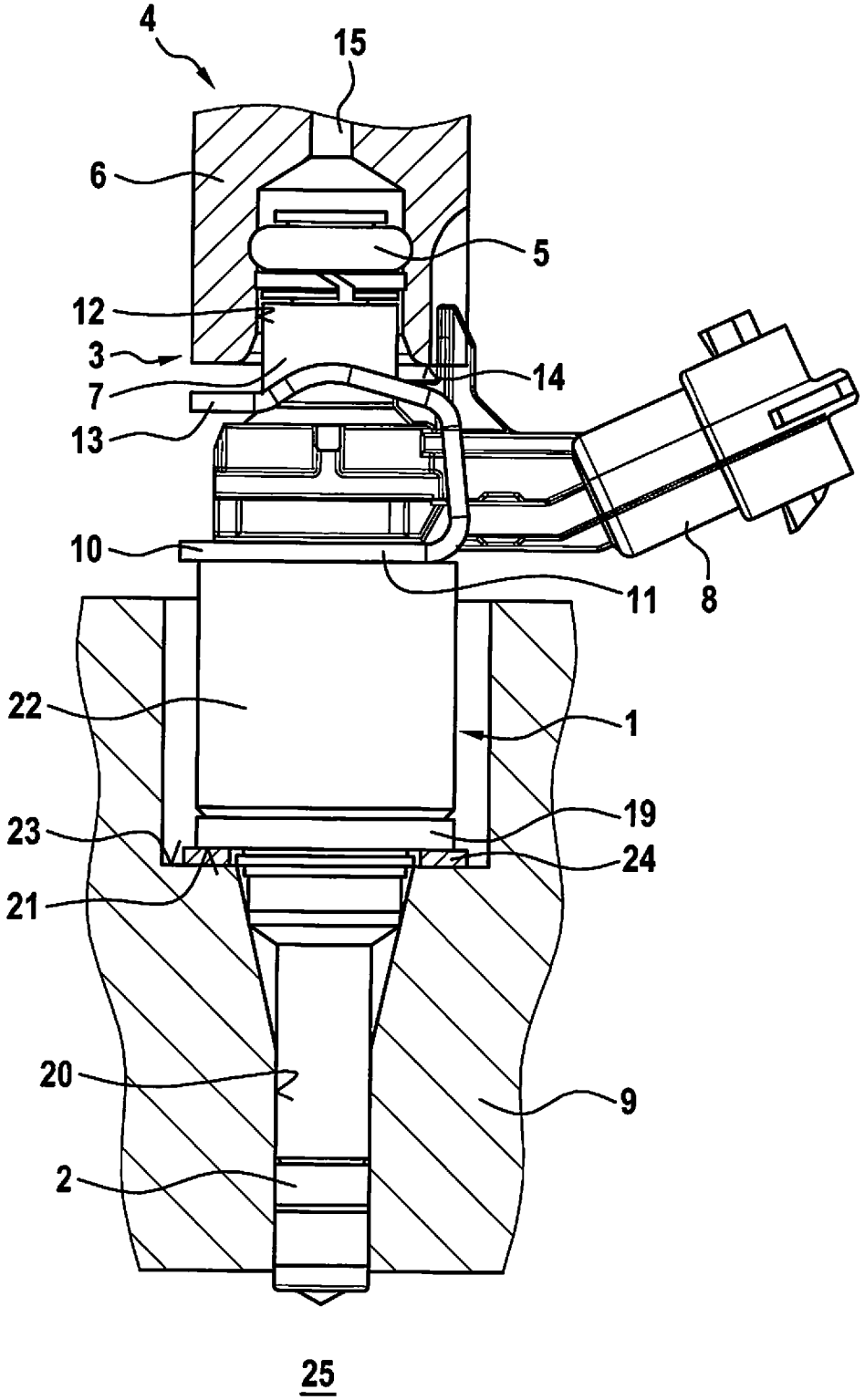
FIG. 1 shows a partial illustration of a fuel injection device in a known configuration, including a disk-shaped intermediate element.

One known specific embodiment of a fuel injection device is explained in greater detail below, with reference to FIG. 1, for an understanding of the present invention. FIG. 1 illustrates, as one exemplary embodiment, a side view of a valve in the form of an injector 1 for fuel injection systems of mixture-compressing spark ignition internal combustion engines. Fuel injector 1 is part of the fuel injection device. Fuel injector 1, which is configured in the form of a direct-injecting injector for direct injection of fuel into a combustion chamber 25 of the internal combustion engine, is installed with a downstream end into a receiving borehole 20 of a cylinder head 9. A sealing ring 2 made in particular of Teflon® ensures optimal sealing of fuel injector 1 with respect to the wall of receiving borehole 20 of cylinder head 9.

A flat intermediate element 24 configured in the form of a washer is inserted between a step 21 of a valve housing 22 (not shown) or a lower end-face side 21 of a support element 19 (FIG. 1) and a shoulder 23 of receiving borehole 20 that extends, for example, at a right angle to the longitudinal extension of receiving borehole 20. With the aid of such an intermediate element 24 or together with a rigid support element 19 having, for example, an inwardly arched contact surface with respect to fuel injector 1, manufacturing and installation tolerances are compensated for, and a bearing is ensured that is free of lateral forces, even when fuel injector 1 is slightly tilted.

Fuel injector 1 on its inflow-side end 3 includes a plug-in connection to a fuel distributor line (fuel rail) 4 that is sealed off by a sealing ring 5 between a connecting piece 6 of fuel distributor line 4, illustrated in a sectional view, and an inlet connector 7 of fuel injector 1. Fuel injector 1 is inserted into a receiving opening 12 of connecting piece 6 of fuel distributor line 4. Connecting piece 6 emerges in one piece, for example, from actual fuel distributor line 4, and upstream from receiving opening 12 has a flow opening 15 with a smaller diameter, via which the flow onto fuel injector 1 takes place. Fuel injector 1 includes an electrical connector plug 8 for the electrical contacting for actuating fuel injector 1.

A hold-down device 10 is provided between fuel injector 1 and connecting piece 6 in order to separate fuel injector 1 and fuel distributor line 4 from one another, largely free of radial force, and to securely hold down fuel injector 1 in the receiving borehole of the cylinder head. Hold-down device 10 is configured as a bow-shaped component, for example as a stamped/bent part. Hold-down device 10 includes a partial ring-shaped base element 11 from which a downwardly bent hold-down bracket 13 extends, which in the installed state rests against a downstream end face 14 of connecting piece 6 on fuel distributor line 4.

The object of the present invention is to achieve improved noise reduction, compared to the known intermediate element and damping disk approaches, in a simple manner, in particular in the noise-critical no-load operation, but also in constant pressure systems at system pressure, via a targeted design and geometry of intermediate element 24. The forces introduced into cylinder head 9 during the valve operation (structure-borne noise), which result in a structural excitation of cylinder head 9 and which are emitted from same as airborne noise, are the primary noise source of fuel injector 1 during the direct high-pressure injection. To achieve an improvement in the noise level, the objective is therefore to minimize the forces that are introduced into cylinder head 9. In addition to reducing the forces caused by the injection, this may be achieved by influencing the transmission behavior between fuel injector 1 and cylinder head 9.

In addition, the aim is for decoupling element 240 to achieve its full function under actual installation conditions with as little stress as possible. Therefore, according to the present invention, a configuration and an installation situation of decoupling element 240 between fuel injector 1 and cylinder head 9 are selected which minimize the tensile stresses and compressive stresses in decoupling element 240.

According to the present invention, decoupling element 240 is characterized in that it is used for reducing the power flow between fuel injector 1 and its installation environment, with the objective of reducing undesirable noise excitation in the surrounding structure. In each case the advantageous features of the spring characteristic are included in the geometric configuration and material selection of decoupling element 240 in the specific embodiments of decoupling elements 240 described below.

Figure 2:
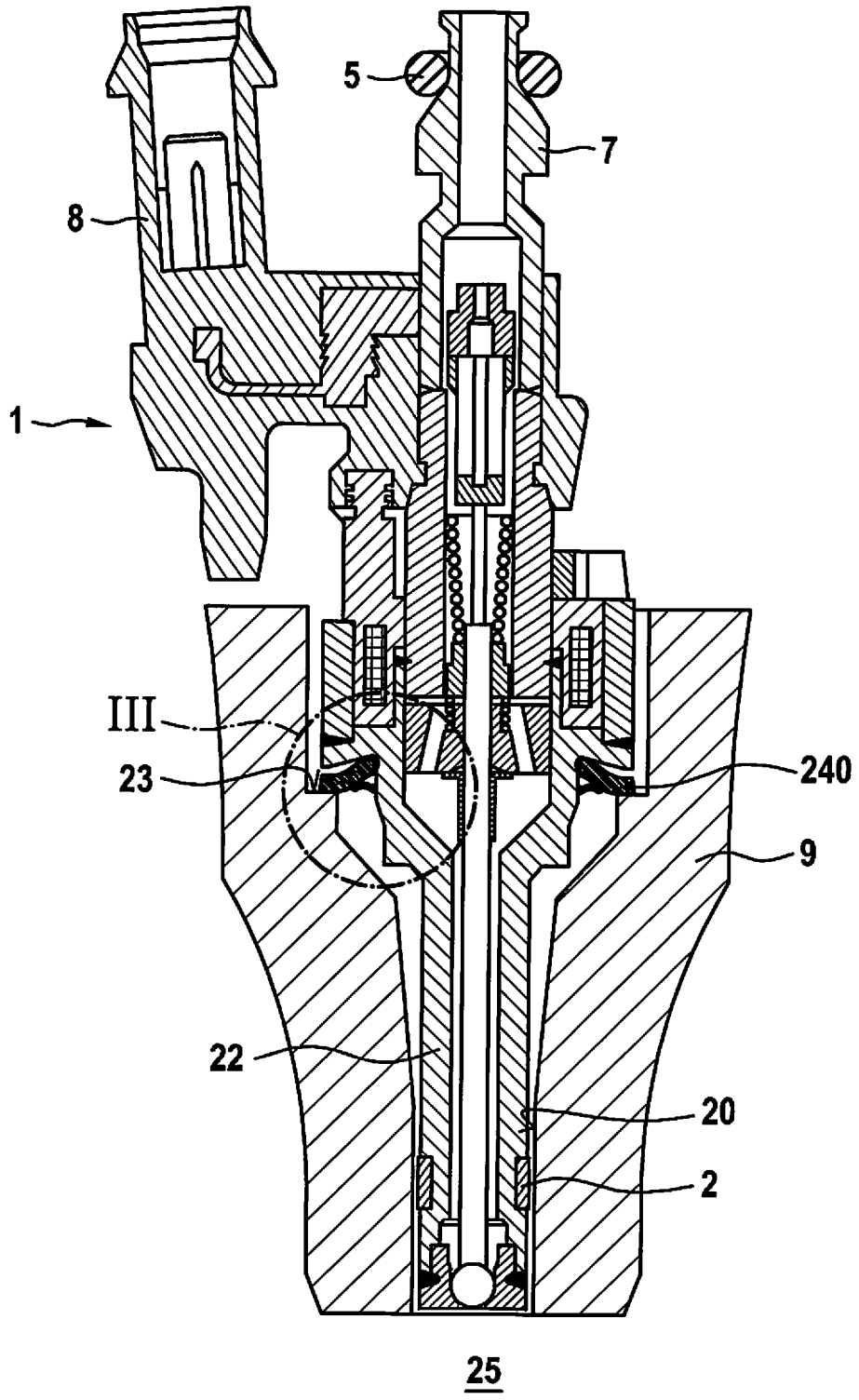
FIG. 2 shows a sectional illustration of a fuel injection device, including a first decoupling element according to the present invention.
Figure 3:
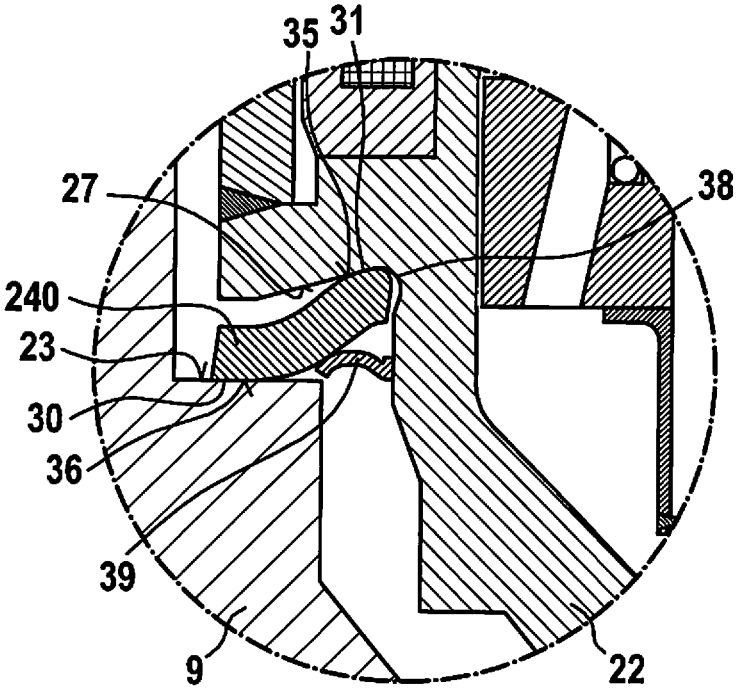
FIG. 3 shows an enlarged detail III from FIG. 2 in a first installation situation of the decoupling element between the fuel injector and the cylinder head.

FIG. 2 shows a sectional illustration of a fuel injection device, including a first decoupling element 240 according to the present invention, while FIG. 3 shows enlarged detail III from FIG. 2 in a first installation situation of decoupling element 240 between fuel injector 1 and cylinder head 9. This embodiment of the fuel injection device involves a system for direct gasoline injection via fuel injectors 1, which, as shown, are operated with an electromagnetic actuator, or also with piezo actuators, and used in a constant pressure system, for example. Decoupling element 240 is advantageously configured as a metallic perforated disk that extends in a ring shape. A metallic material is also suitable due to the fact that it is machinable using cost-effective manufacturing methods (turning, deep drawing, for example) to allow dimensionally accurate production of the desired geometries of decoupling element 240. In particular, it is suitable to manufacture decoupling element 240 as a stamped/bent part. One example of a possible material for decoupling element 240 is austenitic stainless steel 1.4310 (X10CrNi18-8), which has very good formability.

Decoupling element 240 in the installed state includes two support or contact areas 30, 31, a radially outer contact area 30 and a radially inner contact area 31. With outer contact area 30, in the first exemplary embodiment decoupling element 240 rests on shoulder 23 of receiving borehole 20 in cylinder head 9, for example perpendicular to the valve longitudinal axis. With inner contact area 31, decoupling element 240 is supported on valve housing 22 of fuel injector 1 in a ring shape. For this purpose, valve housing 22 includes, for example, a tapering, beveled housing section 27 to which decoupling element 240 and its inner contact area 31 correspond. The installation of decoupling element 240 is thus simplified; in addition, a sphere/cone pairing that is favorable for a tolerance compensation is present which allows a cardanic bearing.

According to the present invention, decoupling element 240 is characterized in that radially inner contact area 31 of decoupling element 240 has a spherically convex contact surface 35 whose curvature is configured with a largely constant spherical radius R1. For a stress-minimized state of decoupling element 240, the midpoint of contact surface 35 resting on the imaginary sphere is ideally situated approximately on the valve longitudinal axis of fuel injector 1. In other words, with spherically convex contact surface 35 in radially inner contact area 31, a spherical segment annularly and circumferentially spans a full 360° about a sphere midpoint situated approximately on the valve longitudinal axis of fuel injector 1.

Decoupling element 240 has a bowl- or cup-shaped configuration overall. With this configuration, optimal use is likewise made of the installation space in receiving borehole 20 of cylinder head 9, which is typically only small, in favor of a beneficial constant lever arm. Likewise spherically convex contact surface 36 in radially outer contact area 30 of decoupling element 240 has either a rounded configuration with a constant radius, or a crowned, spherically curved, or convex configuration with a nonconstant radius. Radius R2 of contact surface 36 of radially outer contact area 30 may be selected to be much larger than radius R1 of spherical contact surface 35 in radially inner contact area 31, as the result of which the fatigue strength-determining tensile stresses in this outer area of decoupling element 240 may be reduced.

Tapering, beveled housing section 27 of fuel injector 1 radially inwardly merges into a rounded recessed area 38, which is adjoined by a housing section that extends perpendicularly in the downstream direction. Rounded recessed area 38 of valve housing 22 allows an optimized, damage-free attachment of decoupling element 240 to fuel injector 1 before it is installed in receiving borehole 20 of cylinder head 9. Prior to installation, a lock washer 39 that is pressed onto or integrally joined to valve housing 22, beneath decoupling element 240, may be provided to captively secure decoupling element 240 on fuel injector 1.

Figure 4:
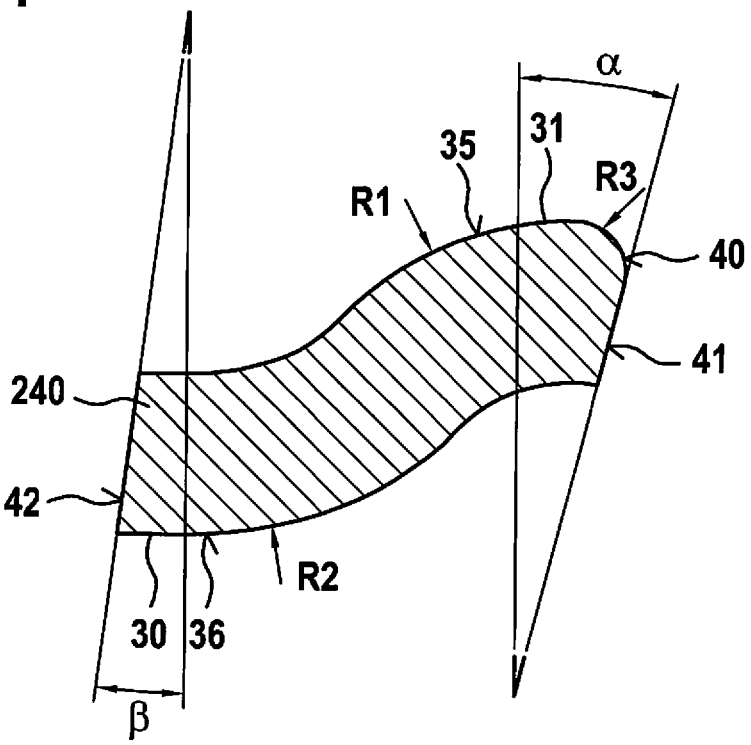
FIG. 4 shows a one-sided sectional illustration of the decoupling element according to FIG. 3 for clarifying the contouring of the decoupling element.

FIG. 4 shows a one-sided sectional illustration of decoupling element 240 according to FIG. 3 for clarifying the contouring of decoupling element 240 in an even further enlarged view. It is clear that decoupling element 240, in addition to the two spherically rounded, radially inwardly and outwardly situated contact surfaces 35 and 36, includes a further rounded inner surface 40 having a radius R3. This radius R3 may be selected to be very small in comparison to radii R2 and R1, since it forms the transition from radially inner contact surface 35 of contact area 31 to inner end face 41 of decoupling element 240. Simulations have shown that with such a shaping according to the present invention, the compressive stresses are absolutely noncritical in this inner area of decoupling element 240.

Inner end face 41 and outer end face 42 of decoupling element 240 advantageously extend at an angle α and β, respectively, with respect to the perpendicular valve longitudinal axis of fuel injector 1 and to the midpoints of the imaginary spheres having radii R1 and R2. The two angles α and β of end faces 41 and 42 in total should be in a range of >2°, since a further contribution to significantly reducing the stresses in decoupling element 240 is provided in this way.

Figure 5:
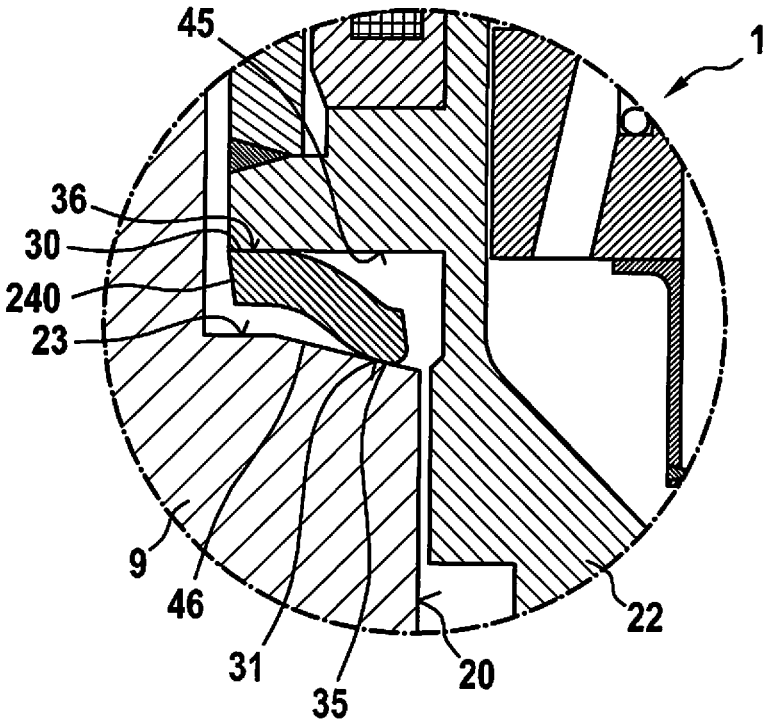
FIG. 5 shows an enlarged detail, analogous to FIG. 3, in a second embodiment according to the present invention, and the installation situation of the decoupling element between the fuel injector and the cylinder head.

FIG. 5 shows an enlarged detail, analogous to FIG. 3, in a second embodiment according to the present invention, and the installation situation of decoupling element 240 between fuel injector 1 and cylinder head 9. In principle, in the installed state, decoupling element 240 is axially turned compared to the approach described above. Thus, in the installed state, decoupling element 240 once again includes two support or contact areas 30, 31, radially outer contact area 30 and radially inner contact area 31. In the second exemplary embodiment, decoupling element 240 with outer contact area 30 now rests against housing wall 45 of fuel injector 1, which extends, for example, perpendicularly with respect to the valve longitudinal axis. Decoupling element 240 with inner contact area 31 is supported in a ring shape on shoulder 23 of receiving borehole 20 in cylinder head 9. Shoulder 23 of receiving borehole 20 includes, for example, a tapering, beveled shoulder section 46 to which decoupling element 240 and its inner contact area 31 correspond. The installation of decoupling element 240 is thus simplified; in addition, a sphere/cone pairing that is favorable for a tolerance compensation is present which allows a cardanic bearing. Decoupling element 240 is brought into a centered position due to the inclination of shoulder section 46 on cylinder head 9.

According to the present invention, decoupling element 240 is once again characterized in that radially inner contact area 31 of decoupling element 240 has a spherically convex contact surface 35 whose curvature is configured with a largely constant spherical radius R1. For a stress-minimized state of decoupling element 240, the midpoint of the imaginary sphere on which contact surface 35 extends is ideally situated approximately on the valve longitudinal axis of fuel injector 1. In other words, with spherically convex contact surface 35 in radially inner contact area 31, a spherical segment annularly and circumferentially spans a full 360° about a sphere midpoint situated approximately on the valve longitudinal axis of fuel injector 1.

All statements made concerning radii R1, R2, and R3 and concerning angles α and β of end faces 41 and 42 likewise apply to the second exemplary embodiment illustrated in FIG. 5, and to the first-described exemplary embodiment.

Due to the double cardanic bearing of decoupling element 240, a constant lever arm that is independent of tolerances may advantageously be ensured during operation between the two radial positions of contact surfaces 35 and 36 of decoupling element 240 over the entire service life.

What is claimed is:

1. A decoupling device for a fuel injection device for a fuel injection system of an internal combustion engine, in particular for direct injection of fuel into a combustion chamber, the fuel injection device including at least one fuel injector and a receiving borehole for the fuel injector, wherein the decoupling device is introduced between a valve housing of the fuel injector and a wall of the receiving borehole, the decoupling device having a bowl-shaped or a cup-shaped configuration, with a radially outer contact area and a radially inner contact area with which the decoupling device is radially inwardly and radially outwardly placeable against the fuel injector and a shoulder of the receiving borehole;

wherein the radially inner contact area of the decoupling device has a spherically convex contact surface, the curvature of which has an approximately constant spherical radius or a constant spherical radius, wherein the radially outer contact area of the decoupling device has a spherically convex contact surface whose curvature is configured with a radius that is larger than the radius of the spherically convex contact surface of the radially inner contact area.

2. The decoupling device of claim 1, wherein the midpoint of the imaginary sphere on which the contact surface extends is situated approximately on the valve longitudinal axis of the fuel injector.

3. The decoupling device of claim 1, wherein the spherically convex contact surface that circumferentially extends a full 360° is configured as a spherical segment.

4. The decoupling device of claim 1, wherein the spherically convex contact surface of the radially inner contact area of the decoupling device corresponds to a tapering, beveled housing section of the fuel injector or to a tapering, beveled shoulder section on the cylinder head.

5. The decoupling device of claim 1, wherein the inner end face and the outer end face of the decoupling device extend at an angle with respect to the perpendicular valve longitudinal axis of the fuel injector, the two angles of the end faces in total being in a range of >2°.

6. The decoupling device of claim 1, wherein a lever arm between the two radial positions of the contact surfaces of the decoupling device remains constant during operation.

7. The decoupling device of claim 1, wherein the decoupling device has an annular disk shape and an overall bowl-shaped or cup-shaped configuration.

8. The decoupling device of claim 1, wherein the decoupling device is manufacturable as a stamped part, a bent part or a turned part.

9. The decoupling device of claim 1, wherein the receiving borehole for the fuel injector is in a cylinder head, and the decoupling device with its radially inner or outer contact area rests with a cardanic bearing on the shoulder of the receiving borehole.

* * * * *